United States Patent [19]

Feltz et al.

[11] 3,966,470

[45] June 29, 1976

[54] PHOTO-CONDUCTIVE COATING CONTAINING Ge, S, AND Pb OR Sn

[75] Inventors: Adalbert Feltz; Johannes Opfermann; Bernd Voigt, all of Jena; Walter Seliger, Dresden, all of Germany

[73] Assignee: VEB Pentacon Dresden, Dresden, Germany

[22] Filed: June 3, 1974

[21] Appl. No.: 475,381

[30] Foreign Application Priority Data

Aug. 22, 1973 Germany ..... 173134

[52] U.S. Cl. ..... 96/1.5; 252/501; 29/572; 313/94; 338/15; 357/2; 357/61; 75/134 B; 75/134 G; 75/134 R

[51] Int. Cl.[2] ..... G03G 5/04; H01J 39/00

[58] Field of Search ..... 96/1.5; 252/501; 29/572; 313/94; 338/15; 357/2, 61; 75/134 B, 134 G, 166 R

[56] References Cited

UNITED STATES PATENTS

| | | | |
|---|---|---|---|
| 2,901,348 | 8/1959 | Dessauer et al. | 96/1.5 |
| 3,271,591 | 9/1966 | Ovshinsky | 357/2 X |
| 3,312,548 | 4/1967 | Straughan | 96/1.5 |
| 3,530,441 | 9/1970 | Ovshinsky | 96/1.5 X |
| 3,607,388 | 9/1971 | Hori et al. | 96/1.5 X |
| 3,615,856 | 10/1971 | Sommers | 357/61 X |
| 3,647,427 | 3/1972 | Hanada et al. | 252/501 X |
| 3,801,966 | 4/1974 | Terao | 96/1.5 X |

*Primary Examiner*—Roland E. Martin, Jr.
*Attorney, Agent, or Firm*—William A. Drucker

[57] ABSTRACT

As a photoconductive material there is provided a carrier having a coating thereon of a germanium-sulphur-lead alloy or a germanium-sulphur-tin alloy.

2 Claims, No Drawings

PHOTO-CONDUCTIVE COATING CONTAINING Ge, S, AND Pb OR Sn

BACKGROUND OF THE INVENTION

The invention relates to a photoconductive coating, especially for electro-photographic purposes.

Among the materials proposed for the production of electro-photographic coatings, selenium occupies a special place by reason of its physical and technological suitability as regards the range of use.

Nevertheless electro-photographic selenium coatings have three main drawbacks. Firstly in general they are not usable without limitations for both charging polarities, secondly their spectral sensitivity does not extend far enough into the red for a series of applications and thirdly both above a relatively low temperature (70° to 80°C.) and under the action of particular physical and chemical conditions, accelerated crystallisation must be expected, whereby the coatings become useless.

It is the purpose of the invention to avoid these disadvantages.

The object of the invention is to produce a photoconductive coating capable of bipolar charging which has an extended spectral sensitivity and a high thermal and chemical stability.

SUMMARY OF THE INVENTION

According to the invention this problem is solved in that a photoconductive material comprising a carrier and a homogeneous, vitreous coating thereon, said coating comprising an alloy including germanium, sulphur and a further constituent selected from the group consisting of lead and tin. The germanium proportion preferably lies between 17.7 and 42.5% at. the sulphur proportion between 54.5 and 61% at. and the lead proportion between 0.1 and 24.5% at. or the germanium proportion between 21 and 41% at. the sulphur proportion between 55 and 61% at. and the tin proportion between 0.1 and 22% at.

The coating according to the invention is vaporised in homogeneous form under high vacuum directly or by way of a further semi-conductor intermediate layer on to a suitable coating carrier in thicknesses between 0.2 and 200$\mu$m. The intermediate layer preferably consists of a coating of 15 to 150$\mu$m in thickness of amorphous selenium. Likewise the intermediate layer can consist of a polyxylylidene coating, the saturation potential of which is greater than 200 V. Apart from this material usable for electro-photographic purposes, one obtains a photo-conductive cell of high ohmic value if a coating of the composition Ge 20.0, S 56.5, Pb 23.5 is vaporised on to a quartz plate provided with metal electrodes of serpentine form.

Irrespective of whether the photo-conductive coating according to the invention is used as individual coating or in combination with other semi-conductive coatings in electro-photography on the one hand or on the other hand for the production of photo-conductive cells, its range of use is considerably extended in comparison with photo-conductive materials known hitherto.

The invention will be explained below by reference to several examples:

EXAMPLE 1

From an indirectly heated vaporiser channel of tantalum, a $2.10^{-5}$ Torr, vitreous photo-conductive material of the composition Ge 23.5, S 56.5, Pb 20.0 is vaporised as a coating of 80$\mu$m thickness directly on to an aluminium plate heated to 90°C, and then ventilated and cooled.

Such a plate can be charged up by means of a "Corotron" charging apparatus at ± 9 kV high tension, exposed with a brightness master at a colour temperature of 2850° K with a positive or negative original in such manner that the brightest parts receive an exposure of 140 lux and then developed with a cascade developer into a transferable powder image.

It is also possible to carry out the exposure of the coating behind a red filter of 2 mm. thickness of the Schott RG 1 type. The requisite exposure for the production of a latent image capable of good development here amounts — measured before the film — to 210 lux.

EXAMPLE 2

In the manner as represented in Example 1, a coating 80$\mu$m in thickness of composition Ge 23.5, S 56.5, Sn 20 is applied by vaporisation and charged. After illumination with a brightness master with 200 lux, a latent image capable of development to good quality is produced.

EXAMPLE 3

The photo-conductive coating according to the invention is also usable in combination with other semiconductor coatings. In this case the first coating has the task of ensuring the desired spectral distribution of the electro-photographic sensitivity and the polarity-independent charge capacity, while other necessary properties, for example a low dark discharge rate, are guaranteed by the further semi-conductor coating. A combination with selenium is especially advantageous.

For this purpose firstly in known manner a coating of amorphus selenium of 80$\mu$m thickness is generated on an aluminium plate. A vitreous coating of the composition Ge 28.3, S 56.5, Pb 15.2 is vaporised on to this coating at 60°C. and $2.10^{-5}$ Torr in such thickness that the transparency of a test glass also coated by vaporisation at the same time for incandescent light of 2850° K amounts to just 5%. The recording element thus produced can be subjected to an electro-photographic process as in Example 1.

EXAMPLE 4

The photo-conductive coating in accordance with the invention is also usable for the production of photoconductive cells of high ohmic value.

For this purpose a quartz plate provided with metal electrodes of serpentine form is vapour-coated at $2.10^{-5}$ Torr with a vitreous coating of 10$\mu$m thickness of the composition Ge 20.0, S 56.5, Pb 23.5 as in the other examples. The parameters of the photo-conductive cell can be determined in known manner by the geometric dimensions, including the particular formation of the electrodes.

On illumination with incandescent light of colour temperature 2850°K of intensity 50 lux, the resistance of this component drops to 0.1% of the dark value.

We claim:

1. A photoconductive material comprising a carrier and a homogeneous, vitreous coating thereon, said coating comprising an alloy consisting essentially of germanium, sulphur and a further constituent selected from the group consisting of lead and tin, the thickness of said coating being between 0.2 and 200$\mu$m, the atom percent of Ge being between 17.7 and 42.5 and that of S between 54.5 and 61 when lead is used, the atom percent of Ge being between 21 and 41 and that of S between 53 and 61 when tin is used, the atom percent of the lead being between 0.1 and 24.5 and that of the tin between 0.1 and 22.

2. A photoconductive cell comprising a quartz carrier and a homogeneous, vitreous coating thereon comprising about 20.0 atom per cent germanium, about 56.5 atom per cent sulphur and about 23.5 atom per cent lead, and metal electrodes in contact with said coating, the thickness of said coating being between 0.2 and 200$\mu$m.

* * * * *